US009752574B2

(12) United States Patent
Scheerer et al.

(10) Patent No.: US 9,752,574 B2
(45) Date of Patent: Sep. 5, 2017

(54) RINSING ARRANGEMENT FOR TRIBOLOGICAL CONTACT AREAS AND ROTARY VANE PUMP WITH SUCH AN ARRANGEMENT

(75) Inventors: Rene Scheerer, Freudenstadt (DE); Patrick Steiner, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 335 days.

(21) Appl. No.: 13/325,468

(22) Filed: Dec. 14, 2011

(65) Prior Publication Data

US 2012/0164016 A1 Jun. 28, 2012

(30) Foreign Application Priority Data

Dec. 14, 2010 (DE) ..... 10 2010 054 416

(51) Int. Cl.
*F04C 2/344* (2006.01)
*F04C 14/22* (2006.01)
*F04C 15/00* (2006.01)

(52) U.S. Cl.
CPC ..... *F04C 2/344* (2013.01); *F04C 14/223* (2013.01); *F04C 2270/16* (2013.01)

(58) Field of Classification Search
CPC .... F04C 14/223; F04C 2270/16; F04C 2/344; F04C 15/0088; F16C 29/025; F16C 9/00; F16K 41/02
USPC ..... 418/183; 417/199.1; 428/155; 184/5.1; 384/12, 283; 251/355
See application file for complete search history.

(56) References Cited

U.S. PATENT DOCUMENTS

| | | | | |
|---|---|---|---|---|
| 2,489,517 | A * | 11/1949 | Brown | 310/75 C |
| 3,289,603 | A * | 12/1966 | Pettibone | 418/131 |
| 3,902,347 | A * | 9/1975 | Ridgway | B21D 24/12 100/214 |
| 4,571,358 | A * | 2/1986 | Suh et al. | 428/155 |
| 5,183,392 | A * | 2/1993 | Hansen | 417/203 |
| 5,879,406 | A * | 3/1999 | Lilley | 623/22.15 |
| 6,089,756 | A * | 7/2000 | Ono | F16C 9/00 384/283 |
| 6,645,251 | B2 * | 11/2003 | Salehi et al. | 623/20.28 |
| 6,895,855 | B2 * | 5/2005 | Doll | 92/72 |
| 2001/0036412 | A1 * | 11/2001 | Konishi | 417/220 |
| 2003/0007875 | A1 * | 1/2003 | Watanabe et al. | 417/220 |
| 2005/0100448 | A1 * | 5/2005 | Graf et al. | 417/273 |
| 2009/0017153 | A1 * | 1/2009 | Condo | 425/565 |
| 2010/0038144 | A1 * | 2/2010 | Stauffer | 175/371 |
| 2010/0119383 | A1 * | 5/2010 | Merz et al. | 417/199.1 |
| 2010/0255762 | A1 * | 10/2010 | Mandel et al. | 451/60 |
| 2011/0278489 | A1 * | 11/2011 | Linser et al. | 251/355 |

FOREIGN PATENT DOCUMENTS

DE 10 2007 032 103 A1 11/2008

* cited by examiner

*Primary Examiner* — Mark Laurenzi
*Assistant Examiner* — Paul Thiede
(74) *Attorney, Agent, or Firm* — Maginot, Moore & Beck LLP

(57) ABSTRACT

A cooling and lubricating arrangement of tribological contact areas is disclosed. The arrangement includes tribological contact areas that slide over one another, of which at least one contact area has a surface contour with surface depressions in which a lubricant is stored. The surface contour forms a number of elongate grooves, the gap heights of which, at least in respect of respectively two adjacent grooves, are preferably different.

11 Claims, 3 Drawing Sheets

RINSING ARRANGEMENT FOR TRIBOLOGICAL CONTACT AREAS AND ROTARY VANE PUMP WITH SUCH AN ARRANGEMENT

This application claims priority under 35 U.S.C. §119 to patent application no. DE 10 2010 054 416.7, filed on Dec. 14, 2010 in Germany, the disclosure of which is incorporated herein by reference in its entirety.

BACKGROUND

The present disclosure relates to a rising arrangement for tribological contact areas for cooling and lubricating the latter and in particular to a rotary vane pump with an adjustable lifting ring, which is provided with a rinsing arrangement according to the disclosure.

In principle, tribology examines friction, lubrication and wear of bearings, guides, gears, motors and other machine elements. In addition to developing suitable lubricants, questions in respect of material selection, surface coating and surface topography are at the forefront of current developments. In addition to questions from mechanical engineering, there are numerous further fields in which friction and wear are of great importance, for example in endoprosthetics.

In the case of hydraulic machines such as e.g. rotary vane pumps, but also in the case of other machines with components that are in frictional contact, there is the basic problem of adhesive wear and abrasive wear resulting therefrom at so-called tribological contact points, particularly if a normal force acts on these contact points/areas and the latter merely move microscopically, i.e. only very little, with respect to one another, at least over a certain period of time. There is virtual dry operation at the contact point, in which the tribological partner "fluid" is barely or not at all present. As a result, there is overheating of the areas, coking of the possibly present remaining fluid, frictional corrosion and, not least, premature adhesive wear. Adhesive wear may also occur in the case of macro-movements where very much frictional heat is generated.

A pump unit with a main pump and a charge pump, which has an adjustable delivery volume and is embodied as a rotary vane pump, is mentioned here as a user-related example, as known, inter alia, from the prior art, for example as per DE 10 2007 032 103 A1.

This pump unit comprises an axial piston pump as the main pump, the rotary vane pump also being driven via the driveshaft thereof. Here, the rotor of the rotary vane pump is seated directly on the extended driveshaft of the main pump in a rotationally fixed fashion. Here both pumps are housed in a common housing. As an alternative, the rotary vane pump can also have its own driveshaft, which is coupled to the driveshaft of the main pump via a bushing, for example.

A number of slits lying substantially in axial planes running parallel to the axis of the rotor have been introduced into the rotor of the rotary vane pump. Each slit holds a radially moveable pump vane, which rests against the internal wall of a lifting ring in a sealing fashion as a result of the centrifugal force, which occurs when the rotor rotates, and an occasionally additionally present restricted guidance and slides along said lifting ring. In respect of its relative position with respect to the rotational axis of the rotor, the lifting ring is, with the pump vanes, mounted in the housing in a displaceable fashion with respect to the radial direction in order thus to change the measure of eccentricity of the inner wall of the lifting ring with respect to the rotational axis, and hence to change the swept volume of the rotary vane pump. According to DE 10 2007 032 103 A1, the lifting ring is mounted externally in displaceable fashion in diametrically opposing parallel bearing areas on corresponding counter areas of the housing. The adjustment is brought about as a function of the output pressure of the rotary vane pump, wherein the pressure acts on an operative area on the lifting ring, determined by the spacing of the two bearing areas and the axial extent of the lifting ring, and acts against a spring.

The ratio between guidance length and guidance width of the lifting ring in the pump housing is not very expedient in the known rotary vane pump. As this ratio decreases, the risk of jamming increases. This is linked to the lever length available to the frictional forces.

In view of these circumstances, it is the object of the present disclosure in general to design so-called tribological contact areas such that the fictional forces are kept low. In particular, an increase in the frictional forces as a result of adhesive and abrasive wear to have and as a result of excessive heat influx should be kept low during operation. A particular goal of the disclosure is to improve the tribological contact areas between a lifting ring and its sliding partner in the case of a rotary vane pump such that the frictional forces, and hence the risk of the lifting ring jamming, are kept low.

SUMMARY

This object is achieved by a rinsing arrangement for tribological contact areas, particularly on the lifting ring of a rotary vane pump and the sliding partners thereof, as per the features of patent claim 1. Advantageous embodiments of the disclosure are the subject matter of the dependent claims.

Accordingly, the disclosure provides for a rinsing arrangement of tribological contact areas, consisting of two tribological contact areas that slide over one another, wherein a number of grooves or groove sections are formed in at least one of the tribological contact areas. According to the disclosure, the surface contour forms a number of elongate grooves or groove sections, the gap heights of which in respect of respectively two adjacent grooves preferably differ. As an alternative or in addition thereto, the grooves can extend in labyrinthine fashion, wherein the general alignment of the grooves however should basically run in the movement direction of the surface-structured contact area.

An embodiment in which the grooves run in a zigzagged or wavy form between the different pressure potentials appears particularly expedient. Here, the groove sections running at an angle to the movement direction are particularly helpful because, in the case of an adjustment movement, fluid is dragged out of the grooves into between the contact regions of the tribological contact areas. Here, the groove depth preferably alternates from groove to groove.

The grooves, which act as gaps, interconnect at least two different lubricant pressure potentials that are spaced apart in the movement direction of the tribological contact areas. As a result, a pressure difference or pressure drop is created along the tribological contact areas. This effect can now be utilized by designing and/or aligning the grooves such that the pressure drop as it were leads to the lubricant jumping over the separating webs forming between the grooves, as a result of which dirt particles and abrasive particles adhering to the web surfaces (contact zone sections to the opposing contact area) are rinsed out of the fluid and, moreover, the webs are cooled and lubricated. In respect of the embodiment and/or alignment of the grooves, a number of options are proposed, which can be applied individually or in combination with one another:

1. Different Gap Heights of Respectively Adjacent (Adjoining) Grooves

The flow through the gap is proportional to the 3rd power of the respective gap height. By contrast, the groove cross section is merely proportional to the 1st power of the gap height. It is for this reason that the quotient of through-flow to groove cross section (i.e. the lubricant speed) is very different compared to the respectively adjacent groove. The static pressure of the resting lubricant (liquid) at the higher pressure potential is reduced in the grooves by the dynamic pressure component, which in turn is proportional to the 2nd power of the above-defined lubricant speed. Accordingly, this results in significant static pressure differences to the respectively adjacent groove.

It follows that the volume flows generated by the pressure differences between adjacent grooves pass over the separation or sealing webs between the respectively adjacent grooves, and hence the latter are lubricated, cooled and also cleaned. This avoids or at least improves both the primary adhesive and secondary abrasive wear (inter alia as a result of washing out dirt particles or decomposition products of the lubricant (e.g. coking, etc.) as well).

The depth of the grooves and the depth difference is based on the requirements in respect of the volumetric losses and the cooling/lubricating dependent on the energy influx and the tendency for dry operation.

2. Reducing the Groove Spacing to a Minimum Dependent on the Maximum Permissible Surface Pressure It is advantageous if the number of grooves is increased up to a limit value (resulting from a surface pressure value that may not be exceeded) in order to install the lubrication/cooling in a uniform and finely distributed fashion. Moreover, more lubricant for cooling/lubrication will flow (leak out) over the thin sealing webs/ribs between the grooves resulting from this.

3. Groove Profile Across the Movement Direction, at least in Sections

Moreover, it is advantageous if the profile of the grooves is not, or not everywhere, aligned in the movement direction of the tribological contact areas (although, in principle, it goes without saying that this is also possible). Thus, the grooves can have a wavy shape, a zigzagged shape, a diagonal extent, etc. This carries lubricant over the support webs as a result merely of the relative movement and, moreover, the contradirectional partner (i.e. the opposing contact area) is not always covered at the same point. Here there also is a small flow over the web from one groove section to a subsequent groove section of the same groove because there is a pressure drop between successive groove sections of the same groove as a result of the pressure drop over the entire length of the groove.

4. Labyrinthine Groove Profile

In this profile variant of the grooves there is a pressure difference or a pressure drop along each groove section merely due to the pressure drop when liquid respectively flows through the groove as a result of the hydraulic resistance caused by the groove. Since groove sections with different pressure levels respectively adjoin one another as a result of this, liquid passes over the support webs between the adjoining groove sections, as mentioned above.

BRIEF DESCRIPTION OF THE DRAWINGS

The disclosure will be explained in more detail below on the basis of preferred exemplary embodiments, with reference being made to the accompanying figures.

In detail.

DETAILED DESCRIPTION

Figure 1:
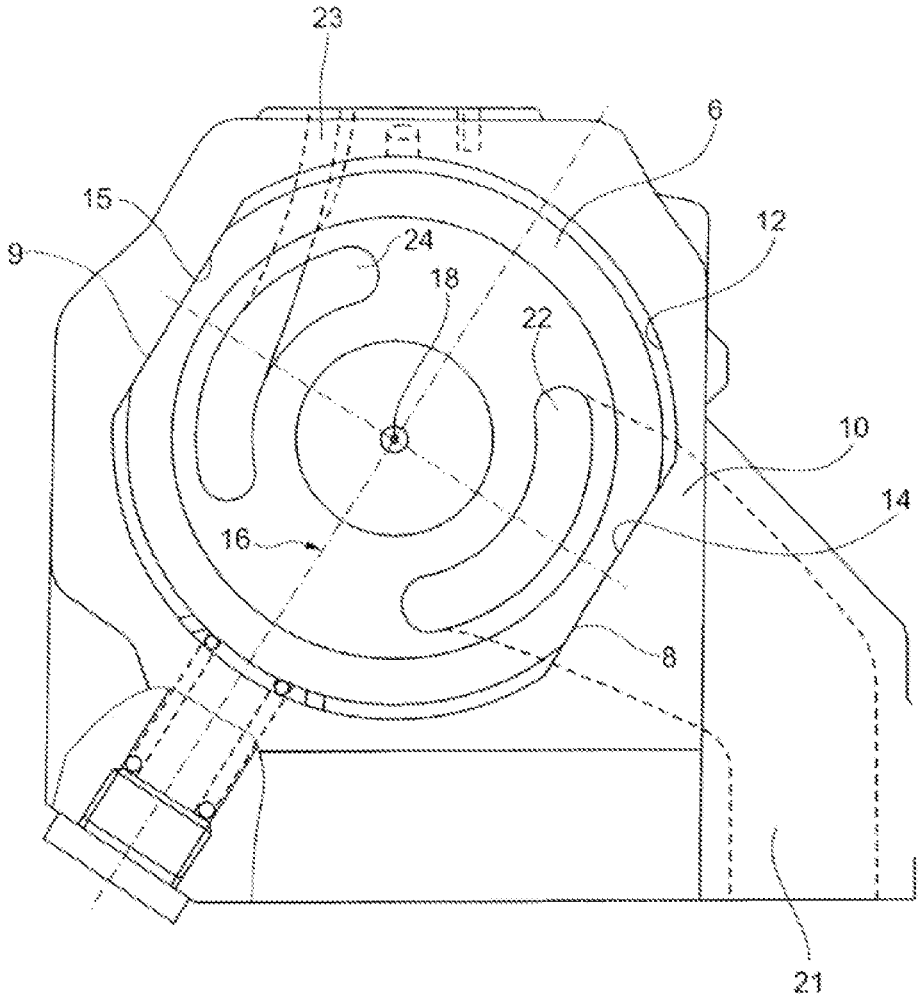
FIG. 1 shows a view in the axial direction of the lifting ring of a rotary vane pump, which lifting ring is situated in a housing and the bearing areas (tribological contact areas) of which are, according to the disclosure, provided with grooves for rinsing.

According to FIG. 1, on opposing sides of a lifting ring 6 of a rotary vane pump and on an elongate recess 12 in a housing 10, in which the lifting ring is situated, there are two mutually corresponding guidance regions 8 and 9 on the lifting ring and guidance regions 14 and 15 on the housing. The housing 10 has a suction channel 21, which opens into a suction kidney 22, and a pressure channel 23, which originates from a pressure kidney 24. The guidance regions 8 and 9 on the lifting ring are formed by bearing areas (tribological contact areas) situated on the external circumference, which bearing areas run parallel to one another and parallel to a displacement axis 16 of the lifting ring 6 and are diametrically opposite to one another in the same direction as the two kidneys 22 and 24. Accordingly, the guidance regions 14 and 15 on the housing are bearing areas (tribological contact areas), with these bearing areas having a greater extent in the direction of the displacement axis than the bearing areas on the lifting ring and so the bearing areas of the lifting ring fully lie thereon. In order to adjust the delivery volume of the rotary vane pump, a force, applied radially from the outside, in the direction of the displacement axis 16 is applied to the lifting ring 6, as a result of which there is a change in the distance between the axis of the lifting ring 6 and the axis 18 of the rotor, not visible in FIG. 1, of the rotary vane pump. During the adjustment, the bearing areas 8 and 9 on the lifting ring 6 slide along the opposing guidance regions 14 and 15 on the housing 10. Here there is a greater load on the bearing areas 9 and 15 because these are situated outside of the pressure kidney 24 and the pump pressure acts from the inside on the lifting ring 6 in the region of the pressure kidney 24.

Figure 2:
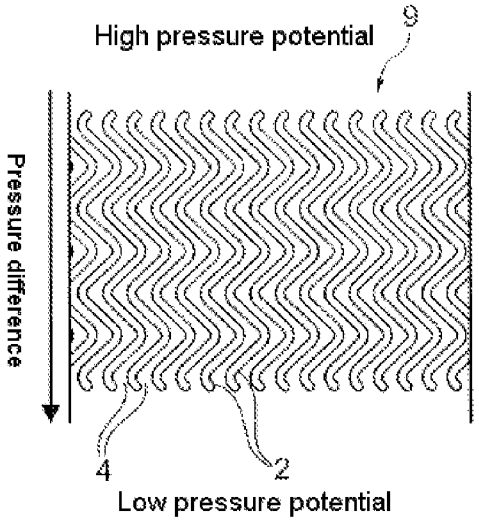
FIG. 2 shows a plan view of a tribological contact area with a surface profile as per a first exemplary embodiment.

According to FIG. 2, a tribological contact area, which is the bearing area 9 in the exemplary embodiment according to FIG. 1, in general has a number of grooves 2 spaced apart in parallel that basically extend along an intended movement direction of the tribological contact area 9. Support or sealing webs 4, which define a support area (-line) on their free upper edge, are formed between the grooves 2 and are in sliding contact with a contradirectional partner (opposing tribological contact area), which is not shown in any more detail in FIG. 1. In order to reduce the friction between the contact areas, provision is made for a preferably liquid lubricant, e.g. oil, which is applied to the contact areas or pressed therein.

Here the assumption is made that, as seen in the movement direction of the tribological contact area 9, the lubricant is under higher pressure on the one side of the tribological contact area 9 than on the other side of the tribological contact area 9. Thus there is a pressure drop over the tribological contact area in the movement direction.

According to FIG. 2, the design of the grooves 2 in the longitudinal extent is such that this results in groove sections that extend across or at an angle to the movement direction. In concrete terms, the grooves as per FIG. 1 have a zigzagged shape along the movement direction.

As a result of this shaping, groove sections of two directly adjacent grooves 2 adjoin one another, which groove sections lie behind one another as seen in the movement direction and thus have different partial pressure levels. These different pressure levels result in a flow over the sealing webs 4 separating the grooves 2, as a result of which particles adhering to said webs are rinsed off and the contact areas are lubricated and cooled. This flowing-over occurs between adjacent grooves, and also, because there is a pressure drop between these groove sections, between groove sections of the same groove, which groove sections lie behind one another in the direction from higher to lower pressure potential and run at an angle to one another.

Directly adjacent grooves 2 are preferably formed with groove depths that differ from one another. In the simplest variant, two different depth values are provided, which are distributed alternately to the respectively adjacent grooves and are preferably substantially constant over the whole length of the groove. However, reference is also made here to the fact that the respective groove depths may change along the groove (e.g. increase or decrease).

Figure 3:
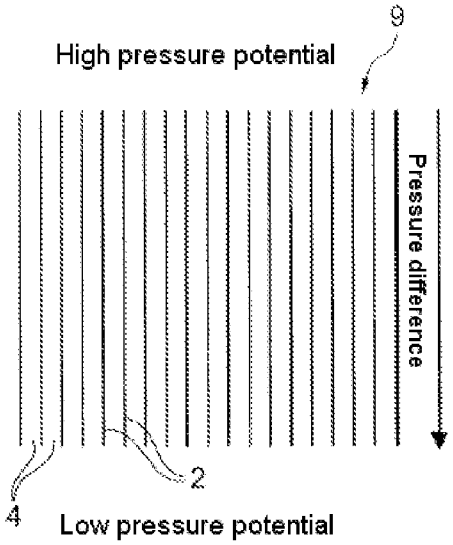
FIG. 3 shows a plan view of a tribological contact area with a surface profile as per a second exemplary embodiment.

In the embodiment according to FIG. 3, the grooves 2 are formed in a straight line and parallel to one another along the intended movement direction of the respective tribological contact area 9. Since there is a uniform pressure drop along the contact area 9 in all grooves 2 in this case, there first of all is no pressure difference between two grooves 2 (90°) which are transverse to the movement direction. However, in this case the respectively adjacent grooves 2 are necessarily formed with groove depths that differ from one another, in accordance with the optional embodiment as per FIG. 1, as a result of which a pressure difference is respectively set locally in a (90°) transverse direction to the movement direction. The effect is the same as in the first exemplary embodiment.

Figure 4:
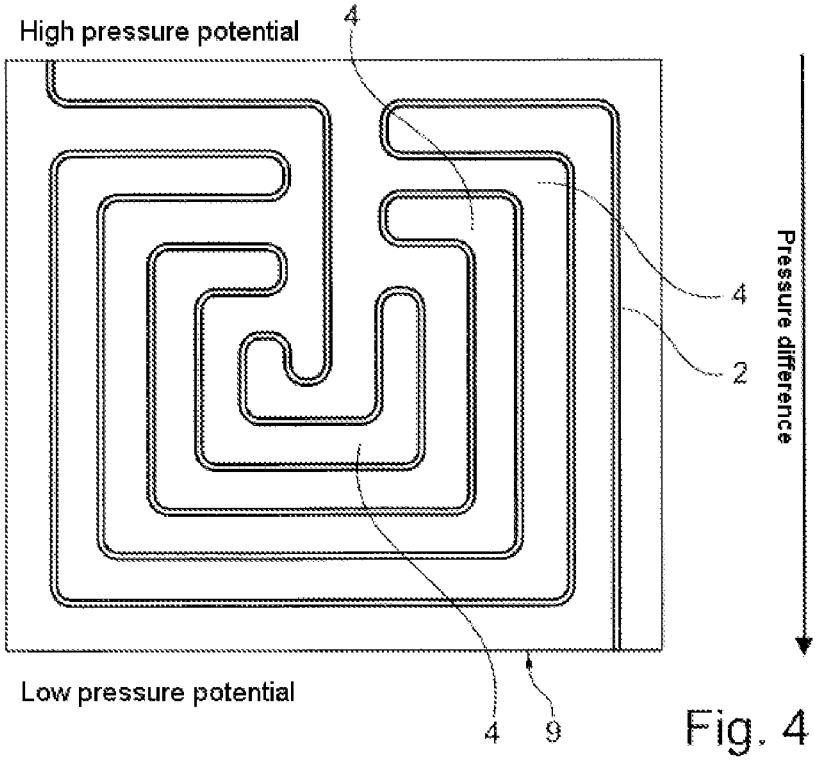
FIG. 4 shows a plan view of a tribological contact area with a surface profile as per a third exemplary embodiment.

In the embodiment as per FIG. 4, the contour of the tribological contact area 9 exhibits a labyrinthine profile consisting of a groove 2, which in the present case while forming right-angled bends extends sections that run parallel to one another over the tribological contact area 9. Accordingly, in a manner comparable to the first preferred exemplary embodiment of the disclosure, this results in groove sections with respectively different sections lengths coming to rest directly behind one another when viewed in the movement direction, up to the front region in respect of the tribological contact area 9 with a higher pressure potential. However, there is a pressure difference between different groove sections because the groove sections are at different distances from the sides with higher and lower pressure potential. There is also a pressure drop between adjacent groove sections as a result of the different length of adjacent groove sections and hence differing gap lengths. Thus, rinsing liquid (lubricating fluid) flows over between both the groove sections running perpendicular to the movement direction and those running parallel to the movement direction.

As a result of this, different pressure levels act upon adjacent groove sections directly behind one another, as seen in the movement direction, and so the same effect can be obtained as already described above on the basis of the first and the second exemplary embodiment. Moreover, in the case of a plurality of grooves, these can be formed with different groove depths.

Figure 5:
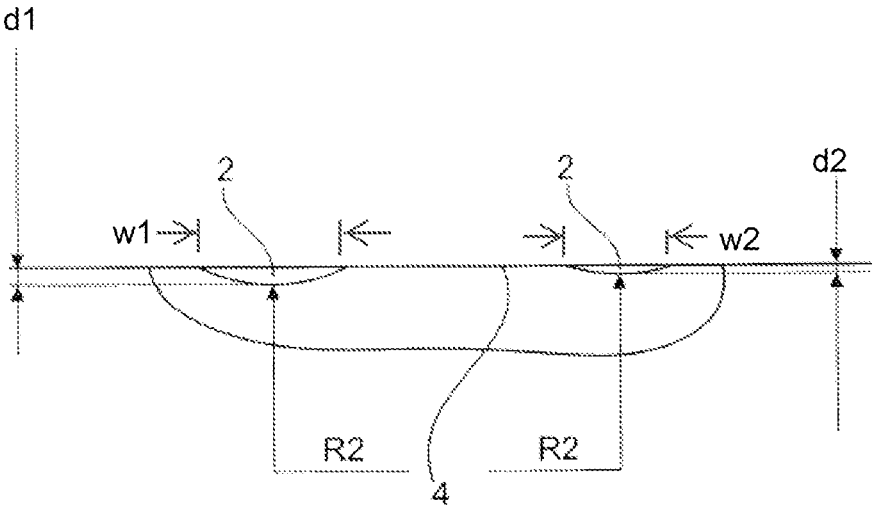
FIG. 5 shows a preferred cross-sectional shape for grooves which are formed into the tribological contact area as per FIGS. 2 to 4.

In this respect, reference is at this point made to FIG. 5, which illustrates a cross section of two directly adjacent grooves as per the preceding description. It is possible to gather from this that both grooves are formed with a partial-circle profile, with the two partial circles having the same radius R2. Meanwhile, the partial circle section of the one groove is greater than the partial circle section of the directly adjacent groove. This leads to the groove depth and in this case also the groove width of the two grooves being different to one another. Here, the depth d1 of the deeper groove is 0.15 mm and the depth d2 of the less deep groove is 0.10 mm. Hence the depth d2 of the one groove is only ⅔ that d1 of the other groove. The groove width w1 of the leftmost groove is thus also greater than the groove width w2 of the rightmost groove. As a consequence, the flow cross section of the grooves differ by a factor of between 3 and 5.

As an alternative to this, it is of course also possible to embody the grooves with different radii or even with different cross-sectional shapes, with the latter optionally leading to different hydraulic resistances of the groove shapes.

Figure 6:
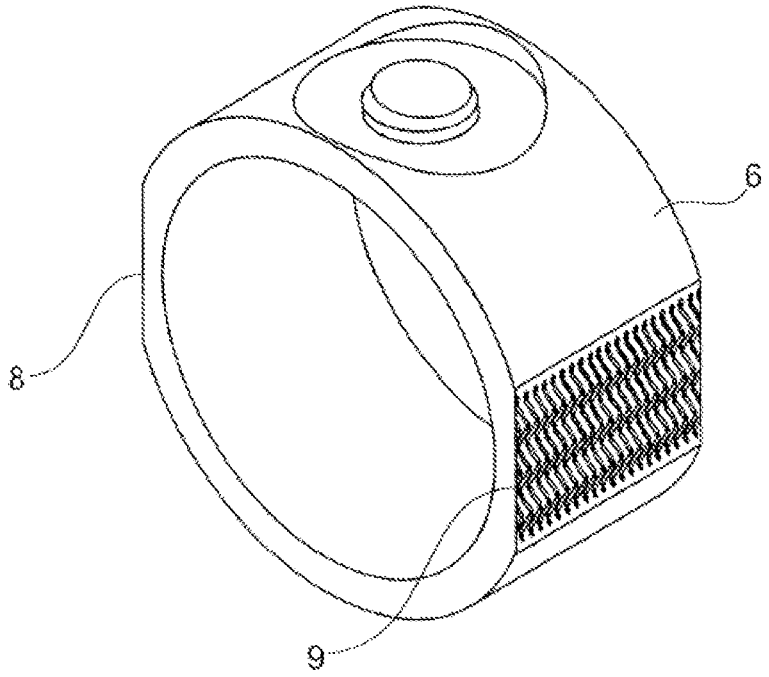
FIG. 6 shows the lifting ring from FIG. 1 with one of the two bearing areas being visible.

Finally, FIG. 6 shows purely a lifting ring 6 as a practical application option of the rinsing arrangement according to the disclosure, as used in particular in rotary vane pumps as per e.g. FIG. 1. The lifting ring is guided between the bearing faces 14 and 15 of the housing 10 (see FIG. 1) on the two diametrically opposing flattenings 8 and 9. The two flattenings constitute two tribological contact areas. The flattening 9, i.e. the flattening in the pressure region, is embodied as per the exemplary embodiment according to FIG. 2. It goes without saying that embodiments as per FIG. 3 or FIG. 4 are also possible. The flattening 8 can likewise also be provided with a rinsing arrangement for improving the cooling and lubrication.

According to FIG. 6, the bearing areas on the lifting ring are equipped with the rinsing arrangement as per one of the preceding exemplary embodiments. However, in principle, the contradirectional partner on the side of the pump housing can exclusively or in combination with the lifting ring 6 have a rinsing arrangement as per the disclosure.

The profile in a tribological contact area can be introduced by stamping, pressing, machining or else by means of lasers. The depth of the profile preferably lies in the region between 0.05 and 0.20 mm.

What is claimed is:

1. A rinsing arrangement, comprising:

sliding partners, each of said sliding partners including a tribological contact area, the contact area of each sliding partner configured and arranged to slide against one another in a direction of linear relative movement between the sliding partners, wherein a plurality of grooves are formed in at least one of the tribological contact areas between opposite ends thereof, each of said plurality of grooves extending from one of said opposite ends to the other of said opposite ends in the direction of linear relative movement, and liquid lubricant situated in said plurality of grooves, wherein each of said plurality of grooves has a flow cross section to flow the liquid lubricant between said opposite ends, said flow cross section defined by the height and width of each groove, wherein the flow cross section differs between at least two adjacent grooves of said plurality of grooves.

2. The rinsing arrangement as claimed in claim 1, wherein at least a portion of at least two adjacent grooves of said plurality of grooves are aligned parallel to one another.

3. The rinsing arrangement as claimed in claim 1, wherein the plurality of grooves includes grooves having a zigzag-shaped profile.

4. The rinsing arrangement as claimed in claim 1 wherein said plurality of grooves at least have longitudinal sections that are at an angle to the direction of relative movement between the tribological contact areas.

5. The rinsing arrangement as claimed in claim 1, wherein the plurality of grooves includes elongated grooves interconnected between at least two different rinsing agent pressure potentials at opposite ends of the elongated grooves in the direction of relative movement between the tribological contact areas, as a result of which a pressure drop is created along the tribological contact areas.

6. The rinsing arrangement as claimed in claim 1, wherein the plurality of grooves are selected from grooves having a rectangular, wedge-shaped or partial-circle-shaped cross section.

7. The rinsing arrangement as claimed in claim 1, wherein the plurality of grooves includes a plurality of adjacent grooves having alternating gap heights.

8. A rinsing arrangement, comprising:

sliding partners, each of said sliding partners including a tribological contact area, the contact area of each sliding partner configured and arranged to slide against one another in a direction of relative movement between the sliding partners, wherein at least one groove is formed in at least one of the tribological contact areas between opposite ends thereof in the direction of relative movement, wherein the at least one groove has a labyrinthine profile, and liquid lubricant situated in said at least one groove, wherein said at least one groove has a flow cross section to flow the liquid lubricant between said opposite ends, said flow cross section defined by the height and width of the groove, wherein the flow cross section differs between at least two adjacent sections of said groove.

9. A rotary vane pump having a rotor and a lifting ring that is adjustable in a pump housing in a plane perpendicular to the rotational axis of the rotor, the lifting ring and pump housing forming sliding partners, the eccentricity of which can be set by displacing the lifting ring along tribological contact areas that are in sliding contact in the direction of the perpendicular plane between the pump housing and the lifting ring, the rotary vane pump comprising:

a rinsing arrangement for the sliding partners including a plurality of grooves formed in at least one of the tribological contact areas that slide against one another, each of said plurality of grooves extending between opposite ends of said at least one tribological contact area in the direction of the perpendicular plane, with fluid lubricant being situated in said plurality of grooves, wherein each of said plurality of grooves has a flow cross section to flow the liquid lubricant between said opposite ends, said flow cross section defined by the height and width of the groove, wherein the flow cross section differs between at least two adjacent grooves of said plurality of grooves.

10. The rotary vane pump as claimed in claim 9, wherein one of said tribological contact areas is formed on the outside of the lifting ring outside of a region where high pressure acts on the inside of the lifting ring and the other of the tribological contact areas is formed on the pump housing, at least one of the tribological contact areas equipped with said rinsing arrangement.

11. The rotary vane pump as claimed in claim 10, wherein the lifting ring and the housing each have two tribological contact areas, the corresponding tribological contact areas of the lifting ring and the pump housing in sliding contact with each other and at least one tribological contact area of the corresponding tribological contact areas equipped with said rinsing arrangement.

* * * * *